US005326946A

United States Patent [19]

Schäffeler

[11] Patent Number: 5,326,946

[45] Date of Patent: Jul. 5, 1994

[54] ELECTRICAL SWITCH

[75] Inventor: Alois Schäffeler, Spaichingen, Fed. Rep. of Germany

[73] Assignee: Marquardt GmbH

[21] Appl. No.: 968,328

[22] Filed: Oct. 29, 1992

[30] Foreign Application Priority Data

Nov. 22, 1991 [DE] Fed. Rep. of Germany ..... 4138484
Nov. 25, 1991 [DE] Fed. Rep. of Germany ..... 4138902

[51] Int. Cl.[5] ..... H01H 33/06

[52] U.S. Cl. ..... 200/144 R; 200/151; 200/430

[58] Field of Search ..... 200/144 R, 149 R, 151, 200/61.19, 506, 430

[56] References Cited

U.S. PATENT DOCUMENTS

| | | | |
|---|---|---|---|
| 2,153,396 | 4/1939 | Sambleson | 200/151 |
| 2,254,347 | 9/1941 | Blakesley | 200/506 X |
| 3,348,010 | 10/1967 | Johnson | 200/430 |
| 4,472,614 | 9/1984 | Newland | 200/506 |

FOREIGN PATENT DOCUMENTS

| | | |
|---|---|---|
| 414044 | 3/1936 | Belgium . |
| 480164 | 7/1929 | Fed. Rep. of Germany . |
| 701023 | 1/1941 | Fed. Rep. of Germany . |
| 3126816 | 1/1983 | Fed. Rep. of Germany . |
| 2362483 | 3/1978 | France . |
| 2511807 | 9/1984 | France . |
| 1528568 | 10/1978 | United Kingdom . |
| 2169450 | 7/1986 | United Kingdom . |

OTHER PUBLICATIONS

Erk, E.; Schmelzle, M.: Grundlagen der Schaltgerätetechnik, 1974, Springer-Verlag Berlin 1974, S. 232-242.

*Primary Examiner*—J. R. Scott
*Attorney, Agent, or Firm*—Spencer, Frank & Schneider

[57] ABSTRACT

An electrical switch (1) is proposed which consists of a lower housing component (3) and an upper housing component (2). In receptacles (24) of the lower housing component (3) contact lugs (23', 23") with a normally closed contact (29', 29") are arranged. In the upper housing component (2) a contact element with a switching contact (22) is arranged. The contact element is moved, via a pressure spring (17) and a slider rod (9) to which an actuation element (5) is coupled, so as to flip between the off-position and on-position. At the contact lug (23') which is arranged on the side of the lower housing component (3) facing away from the contact element in the off-position, an arc extinction lug (32) which consists of an extension is attached to the normally closed contact (29').

18 Claims, 3 Drawing Sheets

ELECTRICAL SWITCH

BACKGROUND OF THE INVENTION

The invention relates to an electrical switch having upper and lower housing components which can be connected to one another in a locking fashion. Contact lugs being in a normally off position are arranged in receptacles of the lower housing component. A contact element with a switching contact is arranged in the upper housing component. The contact element is movable via a pressure spring and a slider rod. The slider rod projects out of the upper housing component and is coupled to an actuation element. The contact element is caused to flip between an off (open) position, in which the switching contact does not touch the resting contact, and an on (closed) position, in which the switching contact touches the contacts.

Such electrical switches are used for switching on and off electrical DC or AC circuits in which high currents, for example, of up to 20 A can flow. They are used, in particular, in machine tools with a high power consumption, for example in right angle grinders or circular saws.

German Offenlegungsschrift DE-OS 31 26 816 discloses an electrical switch in which a carriage can be linearly displaced by means of an actuation element via a slider rod and a bow-shaped catch spring, a contact bridge for bypassing the fixed contacts arranged in the housing of the electrical switch being attached to the carriage. When the switch is switched off, in particular at high currents, an arc occurs between the contact bridge and the fixed contacts which causes the contacts to be eroded. If copper is used as material for the contacts, even after a short period of use the impedance of the switch becomes high due to the badly conducting copper oxide produced as a result of the erosion of the contacts so that severe, often unacceptably high heating at the switch occurs. Particularly in DC operation in which, in contrast with AC operation, no zero crossover phase occurs which extinguishes the arc, the erosion of the contacts can be so strong that after a few switching operations and thus after a short period of use the switch becomes unusable.

In order to eliminate these disadvantages, it is known to coat the copper contacts with silver. The silver layer conducts the electrical current with the onset of erosion of the contacts much better than a copper layer. However, this too does not completely prevent the shortening of the theoretically possible service life of the switch. The much higher price for such a silver coating is also disadvantageous.

In addition, switches have also been disclosed in which contact lugs consisting of copper and having a normally opened contact are arranged in the housing, a rotatable contact rocker which is moved by an actuation element via a slider rod and a pressure spring and has a switching contact bypassing the normally opened contacts. Here too, the aforesaid disadvantage occurs, namely very severe erosion at the normally opened contact, which makes the switch unusable even after a short period of use.

SUMMARY OF THE INVENTION

The invention is therefore based on the object of further developing a switch of the type mentioned above in such a way that damaging contact erosion at the normally opened contacts of the contact lugs is prevented.

This object is achieved in an electrical switch of the generic type by means of arranging a contact lug on the side of the lower housing component facing away from the contact element in an off position and attaching an arc extension lug to the normally opened contact of the contact lug.

The advantages obtained with the invention consist in particular in that silver coating the normally opened contacts or the entire contact lugs can D be dispensed with. As a result, considerable cost savings are made. Damaging erosion does not occur at the normally opened contacts so that the service life of the switch according to the invention is considerably lengthened. In addition, as a result, an improved switching function is also obtained since incorrect switchings cannot occur. Finally, the switch according to the invention also requires fewer individual components, and components of simpler design, than that according to the German Offenlegungsschrift DE-OS 31 26 816.

Further advantageous embodiments of the invention includes forming a pin onto the actuation element, in particular by means of plastic injection molding, at the same time as the actuation element is produced, this pin being engaged in a corresponding receptacle on the slider rod. As a result, the rivet connection, previously used in the state of the art between the actuation element and the slider rod, can be dispensed with as a result of which the switch can be ultimately assembled more simply and cheaply.

The contact rocker can be sloping at its peripheral side facing away from the center of rotation and adjacent to the switching contact so that, in the off position of the switch, the contact rocker at most partially touches the contact lugs. As a result, reduced friction between the contact rocker and the contact lugs is achieved so that the switching-on behavior is improved. A further improvement in the switching-on behavior is also achieved by the arrangement in the carrier of a slider plate, which reduces the sliding friction on the side assigned to the upper housing component of the switch, which plate is subsequently in turn attached to the slider rod.

An exemplary embodiment of the invention is illustrated in the drawings and is described in greater detail below.

DETAILED DESCRIPTION OF THE PREFERRED EMBODIMENT

Figure 1:
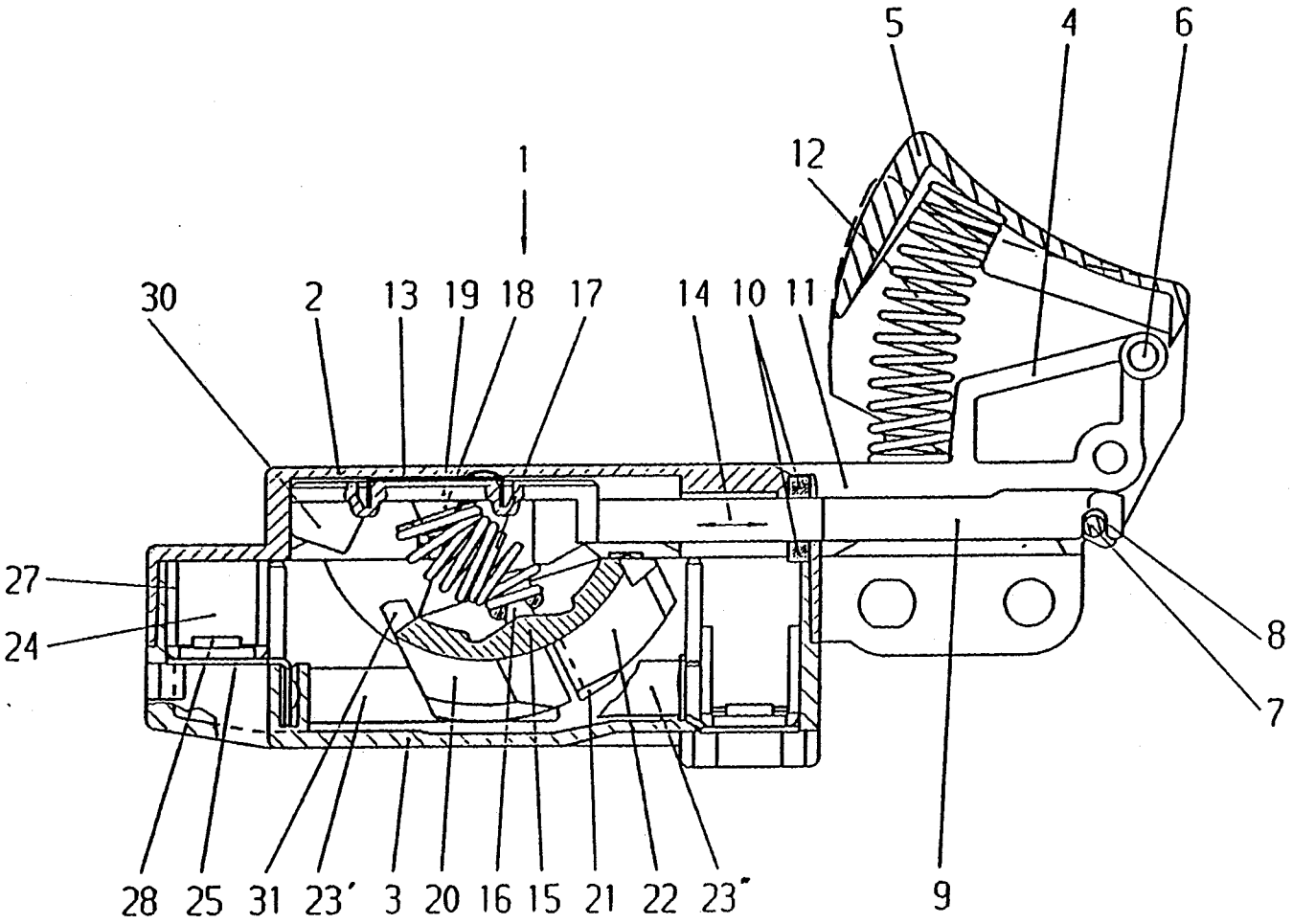
FIG. 1 shows a longitudinal section through the switch according to the invention.
Figure 2:
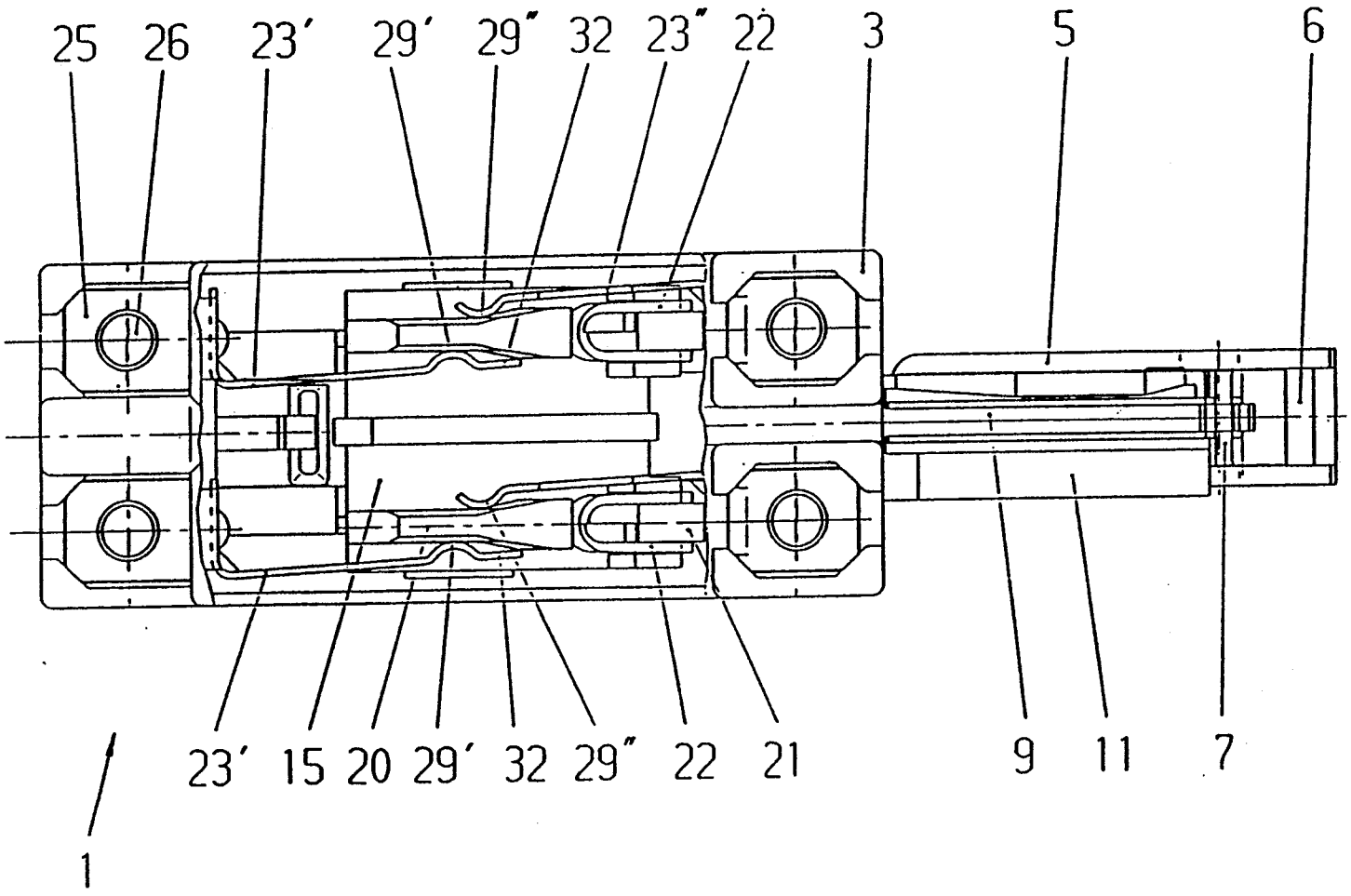
FIG. 2 shows a top view of a partial section of the underside of the switch.

The electrical switch 1 of the present exemplary embodiment is constructed, as is clear from FIG. 2 where the switch is shown in the off-position, as a two-pin make contact or on-off switch and has an upper housing component 2 and a lower housing component 3 shown in longitudinal section in FIG. 1. The upper housing component 2 engages around the upper edge of the lower housing component 3 and is connected to the lower housing component 3 in a locking or snap-in fashion. Of course, the upper housing component and lower housing component can also consist of a single piece. On the upper housing component 2 there is an extension arm 11 with a projection 4 which is attached thereto and on which in turn an actuation element constructed as a pusher cap 5 is rotatably mounted on a pin 6. The pusher cap 5 is under the pressure of a helical pressure spring 12 placed on the extension arm 11.

A pin 7 is formed onto the end of the pusher cap 5 assigned to the upper housing component 2. If the pusher cap 5 is composed, as is customary, of plastic, the pin 7 can be injection molded at the same time as the pusher cap 5 is produced. The pin 7 of the pusher cap is engaged in a receptacle 8 of a slider rod 9 which projects into the interior of the electrical switch 1 so that the rotatable pusher cap 5 is eccentrically coupled to the slider rod 9. At the point at which the slider rod 9 penetrates the upper housing component 2 there is a seal 10 which prevents dirt getting into the electrical switch.

If the pusher cap 5 is actuated counter to the pressure of the helical pressure spring 12, it rotates about the pin 6 (position shown by dashed lines in FIG. 1) and by means of the pin 7 drives the slider rod 9 via the receptacle 8. As a result, the slider rod 9 in FIG. 1 arranged in the upper housing component 2 in a corresponding guide is moved to the right. After the pressure cap 5 is released, said cap is guided back into the initial position by the pressure of the helical pressure spring 12 and moves the slider rod 9 in the opposite direction (to the left in FIG. 1). In this way, the slider rod 9 is moved linearly in the direction of the arrow 14 by means of the pusher cap 5.

Inside the electrical switch 1 a movable contact element is arranged which can be bypassed by the contacts and consists of a contact rocker 15 which is rotatably mounted in the upper housing component 2. In the central area of this contact rocker 15 there is a conical projection 16 on which one end of a pressure spring 17 is held. The other end of the pressure spring 17 is held by a further projection 18 which emerges from a carrier 19 which is in turn attached to the end of the slider rod 9 located in the interior of the electrical switch 1. On the carrier 19 there is a slider plate 13 which faces the upper housing component 2 and is in contact therewith. By virtue of this slider plate, the friction force occurring when the carrier 19 moves in channel 15 is reduced due to the lower coefficient of sliding friction. In addition, there may be a lubricant between the slider plate 13 and the upper housing component 2.

The contact rocker 15 which consists of insulating material, for example plastic, is divided in two at its peripheral side facing away from the center of rotation. The part 21 of the peripheral side facing the slider rod 9 bears, as can be seen in particular in FIG. 2, a planar switching contact 22 which is U-shaped in a plan view. This switching contact 22 can consist of silver-coated copper. As can also be seen in FIG. 2, the part 20 of the contact rocker 15 which faces away from the slider rod 9 and is adjacent to the switching contact 22 slopes towards the peripheral side so that in the off-position of the switch the part 20 of the contact rocker 15 does not rest against, or only partially rests against, the contact lugs 23', 23" located in the lower housing component 3. As a result, reduced friction occurs between the contact rocker 15 and the contact lugs 23', 23", as a result of which the switching-on behavior is improved.

The contact lugs 23', 23" consisting of copper have a formed-on rectangular connecting element 25 with a through-hole 26. In each case one contact lug 23' and 23", respectively, per pole of the two-pole electrical switch 1 is inserted into a receptacle 24 corresponding to the connecting element 25 on the two sides of the lower housing component 3 so that the two contact lugs 23', 23" with their normally opened contacts 29', 29", which are in the shape of a segment of a circle in plan view, lie essentially opposite one another. In addition, a U-shaped connecting element 27 which rests against the connecting element 25 and is made of brass is inserted into the receptacle 24. A thread 28 which corresponds to the through-hole 26 is attached to the U-center piece of the connecting element 27 so that the electrical conductors can be mounted on the connecting element 25 with an appropriate screw.

Figure 3:
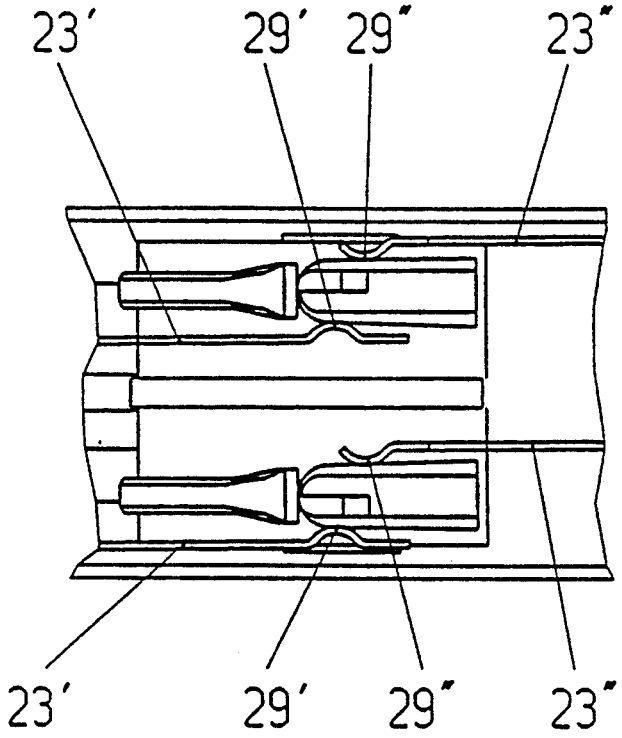
FIG. 3 shows a diagrammatic view of the position of the contacts in the switched-on state and FIG. 4 shows a diagrammatic view of the position of the contacts during switching off.

If the pusher cap 5 is pressed down, as already described the slider rod 9 with the carrier 19 moves in the right-hand direction according to FIG. 1. In this process, the contacting end of the pressure spring 17 is moved along via the projection 18 and the pressure spring moves from the first oblique position which can be seen in FIG. 1 into an unstable intermediate position in which it is located approximately radially with respect to the peripheral side of the contact rocker 15. In this unstable intermediate position, a slight further movement in the actuation direction of the pusher cap 5 is sufficient to cause the pressure spring 17 to jump over into the second oblique position. In this case, the contact rocker 15 is moved along by the other end of the pressure spring 17, via the projection 16 and flips from the off-position into the on-position which can be seen in greater detail in FIG. 3. During the flipping over of the contact rocker 15, the sloping edge of the part 20 moves past the normally opened contacts 29', 29", the normally closed contacts 29', 29" subsequently rest in a sliding fashion on the non-sloping position of the part 20 of the contact rocker 15. During the further movement of the contact rocker 15 into the on-position, the switching contact 22 located at the part 21 ultimately comes into contact with the normally closed contacts 29', 29", as can be seen in FIG. 3, so that a conductive electrical connection is produced between the two contact lugs 23', 23".

If the pusher cap 5 is released again, as already described the slider rod 9 with the carrier 19 according to FIG. 1 moves in the left-hand direction. In this process, movement occurs in the reverse direction with respect to the switching-on process. The switching contact 22 located at the part 21 of the contact rocker 15 is pulled back from the normally opened contacts 29', 29" so that ultimately the sloping edge of the part 20 of the contact rocker 15 is located between the normally opened contacts 29', 29". In this way, the electrical connection is interrupted again and the switch is in the off-position shown in FIG. 2.

From time to time the switching contact 22 may become soldered to the normally opened contacts 29', 29" in the on-position while current is flowing. In these cases, it is not guaranteed that the switching contact 22 will be freed when the pusher cap 5 is released so that the switch remains in the on-position. For such cases, a wedge-shaped nose 30 is attached to the carrier 19. The nose comes into contact with a projection 31 located on an elongated ridge 37 on the contact rocker 15 during the movement of the carrier 19 in accordance with FIG. 1 in the left-hand direction so that the contact rocker 15 is pushed away from the normally opened contacts 29', 29" with the spring force of the helical pressure spring 12 and thus the off-position is reached.

When the switching contact 22 is freed from the normally opened contacts 29', 29" after the pusher cap 5 is released, an arc is produced between the switching contact 22 and the contact lugs 23', 23". In order to avoid contact erosion, the contact lug 23', which is arranged on the side of the lower housing component 3 (left-hand contact lug in FIG. 2) which faces away from the contact rocker 15 in the off-position, has an extension, the so-called arc extinction lug 32 arranged on the normally opened contact 29' in the direction of the contact rocker 15.

Figure 4:
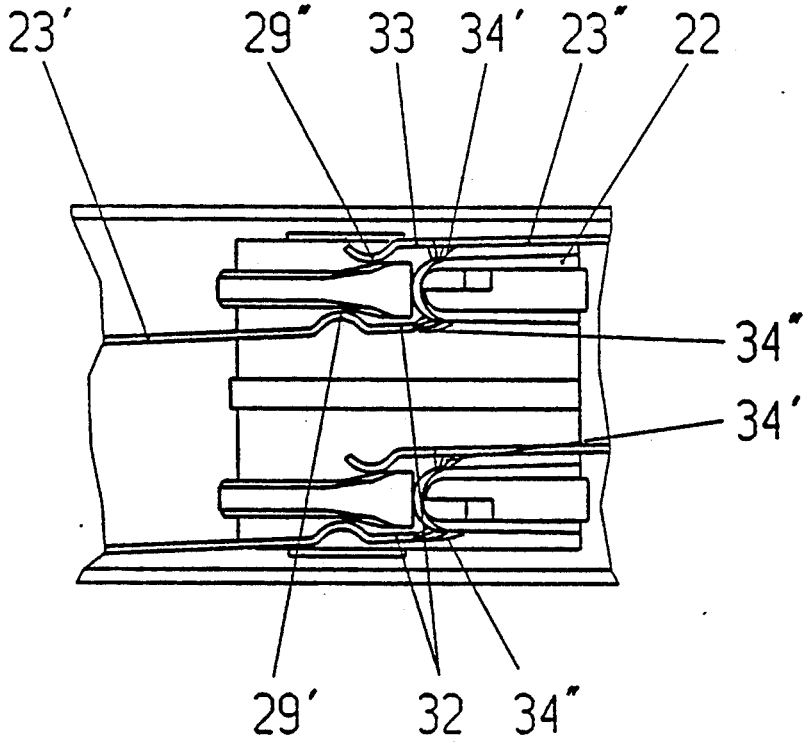

The mode of operation of the arc extinction lug 32 can be seen in greater detail in FIG. 4. When the switching contact 22 pulls back from the normally opened contacts 29', 29", the switching contact 22 passes through the distance along the component 33 of the contact lug 23", which component is located between the normally opened contact 29" and the connecting element 25, and passes along the arc extinction lug 32. The arc 34', 34" which is produced during the switching-off between the switching contact 22 and the normally opened contacts 29', 29" is conducted along by the moving switching contact 22 as far as the component 33 and the arc extinction lug 32. Since the switching contact flips over due to the effect of the pressure spring 17 (see FIG. 1), the arc 34', 34" is moved away from the normally opened contacts 29', 29" within a very short period of time so that the arc 34', 34" is present only momentarily in each case between the switching contact 22 and the component 33 as well as the arc extinction lug 32. Due to the very short period of time in which the arc 34', 34" is present at the normally opened contacts 29', 29", no substantial contact erosion occurs there. When using the switch for DC current, the two arcs 34', 34" are extinguished as soon as the distance between the switching contact 22 and the arc extinction lug 32 has exceeded the specific magnitude required to maintain the arc. When using the switch with AC current, the arc can be extinguished even earlier during the zero cross-over of the phase. In this way, contact erosion due to the arc 34', 34" occurring during the switching-off process is only produced at the arc extinction lug 32 and the part 33 of the contact lug 23" but not at the normally opened contacts 29', 29" used for the conduction of current in the on-position, which consequently no longer has a destructive effect for the functioning of the switch. It is advantageous that the normally opened contacts 29', 29" are no longer destroyed by contact erosion so that the use of expensive silver for the normally opened contacts 29', 29" can be dispensed with and nevertheless a much longer service life can be achieved than in the case of conventional switches provided with copper contacts.

The arc extinction lug 32 is preferably arranged flush with the part of the contact lug 23' located between the normally opened contact 29' and the connecting element 25, and with the same width as the contact lug 23'. Manufacture is particularly simple if the arc extinction lug 32 and the contact lug 23' are composed of a common part. In addition, it has become apparent that the arc extinction lug 32 is effectively prevented from suffering contact erosion already at a length of 2 to 5 mm.

The invention is explained with reference to a switch provided with a contact rocker. It can also be used on other switches, for example on those in which the contact element is moved linearly or the slider rod is coupled or attached directly to the actuation element. However, essential to the invention is the arrangement of an arc extinction lug on the normally opened contact of the contact lug which is arranged on the side of the housing facing away from the contact element in the off-position.

I claim;

1. An electrical switch, comprising:

a lower housing component and an upper housing component connectable to one another in a locking fashion, said lower housing component including contact lug receptacles;

contact lugs arranged in respective ones of said contact lug receptacles of said lower housing component and having normally opened contacts;

a contact element including a switching contact arranged in said upper housing component;

a slider rod slidingly disposed in said upper housing component and having one end projecting out of said upper housing component;

an actuation element coupled to said one end of the slider rod for moving the slider rod between first and second positions in said upper housing component;

a pressure spring operatively arranged between said slider rod and said contact element for flipping said contact element between an off-position when said actuation element moves said slider rod in the first position in which the switching contact does not touch the normally opened contacts of said contact lugs and an on-position when said actuation element moves said slider rod in the second position in which the switching contact touches the normally opened contacts of said contact lugs, wherein one of said contact lugs is arranged on a side of said lower housing facing away from said contact element in the off-position; and an arc extinction lug comprising an extension attached to the normally open contact of said one contact lug.

2. An electrical switch as defined in claim 1, wherein said arc extinction lug extends coplanar with a longitudinal part of said one contact lug.

3. An electrical switch as defined in claim 1, wherein said one contact lug has a width and said arc extinction lug has a width equal to the width of said one contact lug.

4. The electrical switch as defined in claim 1, wherein said arc extinction lug and said one contact lug comprise a common component.

5. An electrical switch as defined in claim 1, wherein said arc extinction lug has a length generally between about 2 mm and 5 mm.

6. An electrical switch as defined in claim 1, further comprising a projection on said upper housing. component, and wherein said actuation element is rotatably attached to said projection.

7. An electrical switch as defined in claim 6, wherein the slider rod is eccentrically coupled to the actuation element.

8. An electrical switch as defined in claim 7, wherein the one end of said slider has a recess and further comprising a pin formed onto the actuation element, wherein said pin engages in the recess of the slider rod for eccentrically coupling the slider rod to the actuation element.

9. An electrical switch as defined in claim 8, wherein the actuation element is comprised of plastic.

10. An electrical switch as defined in claim 9, wherein the pin is injection molded onto the actuation element.

11. An electrical switch as defined in claim 1, wherein the contact element comprises a contact rocker rotatably mounted in the upper housing component.

12. An electrical switch as defined in claim 11, wherein the contact rocker has a center of rotation, and said contact rocker comprises first and second parts arranged on a side of said contact rocker facing away from said center of rotation.

13. An electrical switch as defined in claim 13, wherein said second part includes the switching contact.

14. An electrical switch as defined in claim 14, wherein the first part is adjacent to the switching contact.

15. An electrical switch as defined in claim 15 wherein the first part is tapered.

16. An electrical switch as defined in claim 13, wherein said slider rod has a second end opposite said one end and further comprising a carrier for holding one side of the pressure spring, said carrier being arranged inside the electrical switch near the second end of said slider rod.

17. An electrical switch as defined in claim 16, and further comprising a slider plate located on the carrier between the upper housing component and said carrier.

18. An electrical switch as defined in claim 17, wherein a lubricant is provided between the slider plate and the upper housing component.

* * * * *